United States Patent [19]

Zaugg et al.

[11] 3,999,371

[45] Dec. 28, 1976

[54] AUTOMATIC WINDING DEVICE FOR A WATCH MOVEMENT

[75] Inventors: Roland Zaugg; Josef Flück, both of Grenchen, Switzerland

[73] Assignee: A. Schild S.A., Switzerland

[22] Filed: Dec. 15, 1975

[21] Appl. No.: 641,132

[30] Foreign Application Priority Data

Jan. 6, 1975 Switzerland ..... 42/75

[52] U.S. Cl. ..... 58/82 R

[51] Int. Cl.[2] ..... G04B 5/00

[58] Field of Search ..... 58/80, 81, 82 R, 82 A

[56] References Cited

UNITED STATES PATENTS

| | | | |
|---|---|---|---|
| 3,846,973 | 11/1974 | Kurita | 58/82 R |
| 3,855,779 | 12/1974 | Giger et al. | 58/82 A |

*Primary Examiner*—Stanley J. Witkowski

*Attorney, Agent, or Firm*—Stevens, Davis, Miller & Mosher

[57] ABSTRACT

An automatic winding device for a watch movement includes two frame elements secured to one another to form a unit. The elements support between them a gear train, a pinion, a winding weight integral with the pinion, a lever, a wheel borne by the lever and meshing with the pinion, and a click cooperating with a gear of the gear train. A hairpin strip-spring has one end which acts on the click and another end which acts on the lever. One of the frame elements comprises an elongated recess and the other of the frame elements comprises a notch having edges partially covering the recess. The hairpin strip-spring is inserted in the recess through the notch. The lever and the click are not subjected to the action of the hairpin strip-spring assembly.

8 Claims, 3 Drawing Figures

AUTOMATIC WINDING DEVICE FOR A WATCH MOVEMENT

This invention relates to an automatic winding device for a watch movement, the device comprising two frame elements secured to one another, forming a unit, and supporting between them a gear-train, a pinion, a winding weight integral with the pinion, a lever, a wheel borne by the lever and meshing with the pinion, a click cooperating with a gear of the gear-train, and a strip-spring having an end acting upon the click and another end acting upon the lever.

Devices of this kind are already known. One, for example, is that described in French Pat. No. 2,200,557, which teaches that it is possible to simplify the manufacture and assembly of winding units by having the same spring act upon the lever and upon the click. However, it is necessary to provide means for rendering the spring inoperative when the unit is being assembled. The aforementioned patent describes certain means for achieving that object. Subsequent experience has shown, however, that it is possible to simplify still further the manufacture of the various necessary parts and, in particular, to decrease the number of them, while assembly remains just as easy.

Thus it is an object of this invention to provide an automatic winding device of the kind initially described which is more simple to manufacture than those already known and which ensures the same facility of use and the same operating reliability. More particularly, in the device according to this invention, the lever and the click are not subjected to the action of the spring during assembly. To this end, in the automatic winding device according to the present invention, one of the frame elements comprises an elongated recess, the other frame element comprises a notch whose edges partially cover the recess, and the strip-spring is a hairpin strip-spring adapted for insertion in the recess through the notch.

Figure 1:
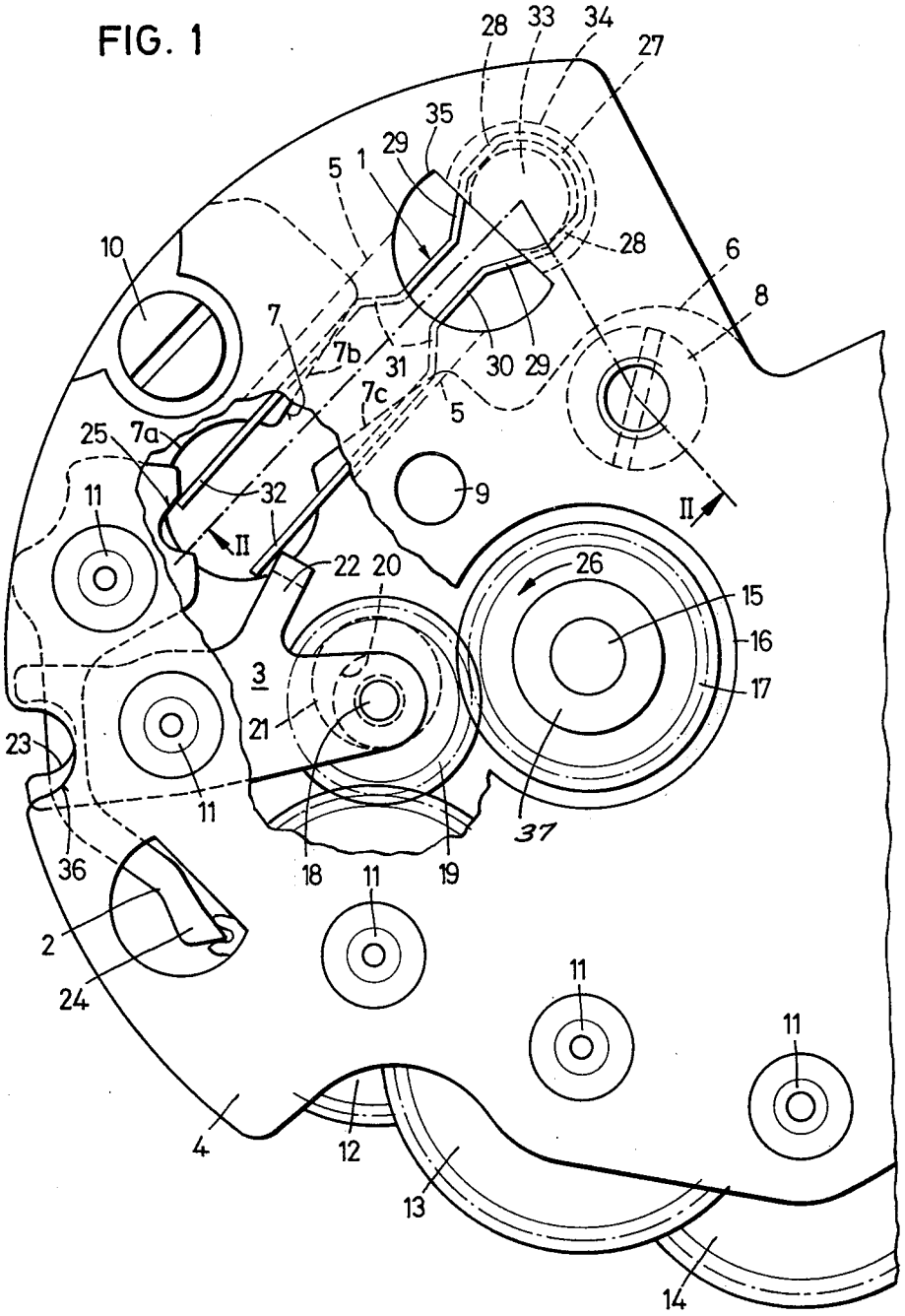
Figure 2:
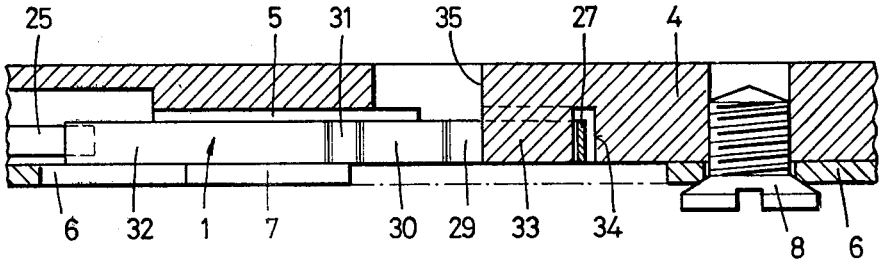
Figure 3:
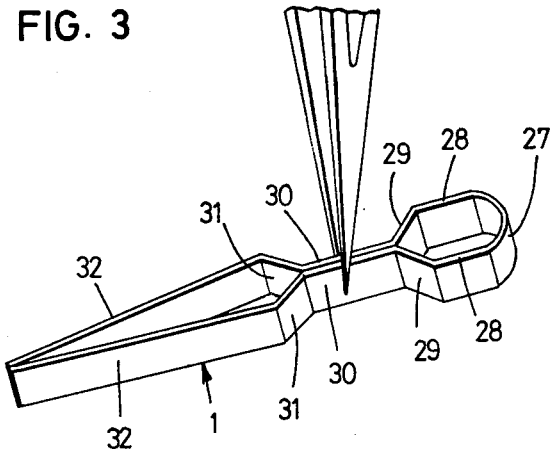

A preferred embodiment of the invention will now be described in detail with reference to the accompanying drawings, in which:

FIG. 1 is a top plan view of the automatic winding device with certain portions of the frame elements broken away, FIG. 2 is a partial section taken on the line II—II of FIG. 1, and FIG. 3 is a perspective view of the spring used in the device illustrated in FIG. 1, showing the appearance of the spring at the time of assembly.

FIG. 1 shows a hairpin spring 1, a click 2, and a lever 3. The device about to be described presents the advantage that the single spring 1, which in normal operation acts upon the click 2 and the lever 3, can be grasped with tweezers, without any risk of being deformed, and placed in its bed after assembly of the unit as a whole.

As shown in FIG. 2, the automatic winding unit proper is composed of an upper frame element or bridge 4, which is a thick plate in which various recesses have been milled, and a lower frame element or bridge 6 consisting of a thin plate, the contours of which coincide with those of the element 4 over the greater part of its periphery. The element 4 comprises a straight recess (5, 34) milled into its thickness and delimited by two parallel sides 5 and an arcuate end side 34. Opposite this recess, the element 6 has a notch 7, at the back of which is an arcuately rounded portion

*7a*, while the mouth of the notch 7 is formed by two symmetrical slanting edges *7b* and *7c* which are oblique to one another and closer to one another than are the sides 5 of the recess and which are disposed symmetrically with respect to the longitudinal axis of the recess. The frame element 6 is secured to the element 4 by means of a screw 8 (FIGS. 1 and 2) and a guide foot 9, while the unit as a whole will be secured to one of the bridges of the movement by means of two screws, one of which, 10, is visible in FIG. 1, whereas the other one and a guide foot are situated in that portion of the unit which, in FIG. 1, is broken away.

The frame elements 4 and 6 carry a series of bearings 11 which provide for the pivoting of the following members forming part of the automatic winding unit: the click 2, the lever 3, a first gear 12 of the automatic winding train, a second gear 13 of that train, and a third gear 14. Moreover, the frame element 6 is integral with a fixed pivot-stud 15 disposed in the center of a circular opening 16 in the frame element 4. An automatic winding weight 37, integral with a winding-weight pinion 17, pivots on the stud 15, where it is held in place by a bolt (not shown) which can be operated from the outside. As a variation, the stud 15 might also be integral with an element separate from the frame element 4. As for the lever 3, it will be seen in FIG. 1 that it is disposed approximately radially between the periphery of the unit and its center, which is occupied by the stud 15. In the edge of the element 4 at the location of the lever 3 there is a notch 36, the function of which will be explained further on. On the end of the lever 3 at the center of the unit is a fixed stud 18 upon which a wheel 19 pivots. At the end of the stud 18 remote from the lever 3 is a cylindrical head 20 which is situated at the level of, and engaged in an opening 21 in, the frame element 6. Since the opening 21 is larger in diameter than the head 20, its sides act as bankings and limit the movements of the lever 3 about its pivoting axis. The amplitude of movement of the lever 3 is such that the wheel 19 can move from the position shown in FIG. 1, in which it meshes with the gear-wheel 12, to another position in which it is disengaged from the wheel 12. Whatever the position of the lever 3 the wheel 19 is always engaged with the pinion 17. Furthermore, the lever 3 has a lateral finger 22 which is bent down at the end and cooperates with one of the arms of the spring 1. At the outer end of the lever 3 is an arcuate notch 23 covering an arc of about 180° and having the same radius as the notch 36.

Whereas the lever 3 extends in a substantially radial direction, the click 2 extends parallel to the periphery of the automatic winding unit. Blanked at one end of it is a beak 24 which cooperates with the toothing of the gear-wheel 12, while at the other end there is a notch 25 which cooperates with the arm of the spring 1 opposite the one which acts upon the finger 22 of the lever 3.

During normal operation, one arm of the spring 1 acts upon the click 2 and the other upon the lever 3, so that if the winding weight 37 rotates in the direction indicated by an arrow 26 in FIG. 1, the wheel 19 is kept engaged with the gear-wheel 12, which is driven counterclockwise, thus lifting the click 2, whereas if the winding weight 37 rotates in the opposite direction from that indicated by the arrow 26, the gear-wheel 12 is locked by the beak 24 of the click 2, and the lever 3 is lifted against the action of the spring 1, so that the wheel 19 is disengaged from the gear-wheel 12.

The exact shape of the spring 1 is shown in FIG. 3. It will be seen that it consists of a narrow metal strip bent into a hairpin shape. The bend comprises a first part 27, which is curved in an arc, followed at the respective ends of that arc by two straight, flat parts 28 substantially parallel to one another. Following each of the parts 28 is an inwardly-directed inclined part 29, also straight, followed with another change of direction by a third straight part 30, then a fourth straight part 31 bent outwardly at an angle to the part 30. Finally, the two free arms 32 extend in a straight line to the end of the spring 1. The parts 29 are oblique to each other as are the parts 31. Upon comparing FIGS. 1 and 3, it will be noted that when the spring 1 is in place in the automatic winding unit described, the two parts 30 are approximately parallel to and spaced from one another. The two arms 32 are likewise approximately parallel and extend between the sides 5 of the recess without touching them. As for the parts 27, 28, and 29, they partially surround a cylindrical stud 33 formed in the thickness of the frame element 4 coaxially with the arcuate end face 34. A crescent-shaped hole 35 is blanked in the element 4 so as to avoid the formation of milling burrs at the points where the end face 34 joins the sides 5. Both of these sides extend to the same depth and are disposed symmetrically with respect to the longitudinal axis of the recess. The parts 28 rest against the lateral surface of the stud 33. The inclined straight parts 29, as well as the rounded part 27, prevent any recoil of the spring 1 by pressing against the stud 33 and the end face 34, respectively. Thus the spring 1 is effectively held firmly in place by the bottom of the recess, the edges of the notch 7, and the stud 33.

At the time of assembly, it is possible to put together the entire unit described before fitting the spring 1 in place. The unit will subsequently be mounted on the rear face of the watch movement, with which the lower element 6 will be in contact. In order to avoid any risk of bending the arbors of the gears of the gear-train, a cylindrical pin having the same diameter as the notch 23 will be used when the frame element 6 is fitted on the element 4. This pin will serve to position the lever 3 in such a way that the wheel 19 is disengaged from the gear-wheel 12. The pin will be engaged simultaneously in the notches 23 and 36 and will lock the lever 3 in the required position. It will then be possible to fix the arbors of the gears in the desired positions and to put the frame element 6 in place without any part being biased by a spring. Finally, the spring 1 will be grasped between the points of tweezers, and the two straight parts 30 of the constricted portion will be pressed together, with the free arms 32 touching at one point, i.e., at their free ends. The spring 1 can then be inserted through the notch 7 with its bend engaging between the stud 33 and the end face 34. There is no danger of deforming the spring 1 during this operation since the two parts 30 are pressing against one another. Thus when the spring 1 is released, it can assume the shape shown in FIG. 1, and its two free arms 32 are able to act upon the click 2 and the lever 3, respectively.

The shape of the notch 7 is such that when the spring 1 is squeezed together as shown in FIG. 3, it can be fitted in place with a vertical motion which engages it in the notch 7 and which engages its bend on the stud 33.

What is claimed is:

1. An automatic winding device for a watch movement, said device comprising two frame elements secured to one another, forming a unit, and supporting between them a gear-train, a pinion, a winding weight integral with said pinion, a lever, a wheel borne by said lever and meshing with said pinion, a click cooperating with a gear of said gear-train, and a strip-spring having an end acting upon said click and another end acting upon said lever, wherein one said frame element comprises an elongated recess and the other said frame element comprises a notch having edges partially covering said recess, said strip-spring being a hairpin strip-spring adapted for insertion in said recess through said notch.

2. An automatic winding device in accordance with claim 1, wherein said frame elements comprise an upper frame element and a lower frame element, said notch being formed in said lower frame element.

3. An automatic winding device in accordance with claim 1, wherein said recess is delimited by two parallel straight sides and an arcuate side, said notch being delimited by two symmetrical edges which are oblique to one another and are closer to one another than are said parallel sides of said recess.

4. An automatic winding device in accordance with claim 3, further comprising a stud projecting from the bottom of said recess and facing said arcuate side of said recess.

5. An automatic winding device in accordance with claim 1, wherein an edge of one of said frame elements and an end of said lever each comprise an arcuate notch, said arcuate notches having the same radius and being so disposed that when they are positioned to coincide, said wheel borne by said lever is disengaged from said gear-train.

6. An automatic winding device in accordance with claim 4, wherein said hairpin strip-spring comprises a bend engaged between said stud and said arcuate side of said recess.

7. An automatic winding device in accordance with claim 6, wherein said hairpin strip-spring comprises two straight sections respectively adjacent to said bend, two straight sections oblique to one another, said straight oblique sections each being adjacent to an end of a respective one of said straight sections adjacent to said bend, and two straight parallel sections each being adjacent to an end of a respective one of said straight oblique sections, said straight oblique sections and said straight parallel sections together forming a constricted portion of said hairpin strip-spring.

8. An automatic winding device in accordance with claim 1, wherein one of said frame elements comprises a hole and said lever bears a pivot-stud for said wheel, said pivot-stud having a cylindrical head disposed at the end thereof remote from said lever, said hole being larger in diameter than said head, and said head being engaged in said hole.

* * * * *